United States Patent [19]

Bergeron et al.

[11] Patent Number: 4,825,799

[45] Date of Patent: May 2, 1989

[54] FLOATING DUCK BLIND

[76] Inventors: Robert Bergeron, 3820 des Cèdres Street, Saint-Hubert, Canada, J4T 3L3; Jean-Pierre Morel, 570 du Golf Road, West Drummondville, Canada, J2B 7T5

[21] Appl. No.: 78,211

[22] Filed: Jul. 21, 1987

[51] Int. Cl.[4] ..... B63B 7/04

[52] U.S. Cl. ..... 114/351; 114/353; 114/77 R; 114/125

[58] Field of Search ..... 114/351–354, 114/361, 125, 77 R, 357, 363; 441/130, 131

[56] References Cited

U.S. PATENT DOCUMENTS

| | | | |
|---|---|---|---|
| 315,297 | 4/1885 | Kenly | 114/351 |
| 714,757 | 12/1902 | Strakele | 114/352 X |
| 1,280,483 | 10/1918 | Johnson | 114/353 |
| 1,843,874 | 2/1932 | Hulst | 114/361 |
| 3,045,262 | 7/1962 | Mitchell . | |
| 3,382,513 | 5/1968 | Jennings . | |
| 3,471,875 | 10/1969 | Lyon . | |
| 3,572,277 | 3/1971 | Schousboe | 114/77 R |
| 3,638,256 | 2/1972 | McIntyre . | |
| 3,638,257 | 2/1972 | Ernst | 114/351 |

*Primary Examiner*—Sherman D. Basinger

[57] ABSTRACT

A foldable sink box consisting of a rigid plasticized hull and a buoyant platform having a large central aperture for engagement by the rigid hull in assembled condition. The hull defines a relatively deep well, for sitting engagement by a hunter. The platform defines two halves, interconnected by an intermediate lengthwisely-extending hinge member. Locking brackets releasably lockingly interconnect the platform to the top edge portion of the rigid hull, concurrently with releasably locking the platform halves in coplanar fashion.

11 Claims, 4 Drawing Sheets

28
24
24A
88
86
54
52A
H
48
CG
R
56B
58
56A
22
54
44
30
51
46
50
42

56B
58
56A 104
114
116
112
112C
54
112A
110A
104
48
108
110
92B 28
24
114
116
98
100
54
100
48
98
96

FLOATING DUCK BLIND

FIELD OF THE INVENTION

The present invention relates to sink boxes used by duck hunters to hide on shallow bodies of water.

BACKGROUND OF THE INVENTION

Duck hunting is considered by a good number of hunters as an interesting sport. This sport can be exercised either on land (in woods, etc. . . . ) or preferably on water, i.e. in a rowboat or in any floating duck blind. The hunting season is usually in the fall, during migration of the ducks, and accordingly, water tends to be colder. A plurality of wooden ducks or decoys are placed on the water at a distance from the floating duck blind, to lure the real ducks which would otherwise fly high in the sky, out of range. The goal for the hunters is accordingly to hide as much as possible, to prevent the ducks from recognizing them.

In view thereof, so-called sink boxes have been developed, consisting of a main flat but thin buoyant platform, from the center of which downwardly projects a hull into which engages a single hunter, so that only the head thereof projects upwardly from the hull. When dense vegetation is put on the platform, the hunter is very well hidden from his prey(s).

A problem with these sink boxes is their transportation. Indeed, theft considerations preclude that they be left unattended about the hunting area between two hunting week-ends. It is in fact cumbersome to carry such sink boxes, and it is a problem to tie them to an automobile because of their bulk which makes them susceptible to breakage.

OBJECTS OF THE INVENTION

The main object of the present invention is therefore to provide a sink box for duck hunters, which will be foldable in view of their transportation when not in use.

A corollary object of this invention is that the sink box be of low manufacturing cost.

A further object of this invention is the comfort of the hunter sitting in the sink box, at rest, at stalk, as well as during the counterblow following the firing of his shotgun.

SUMMARY OF THE INVENTION

In accordance with the objects of the present invention, there is disclosed a foldable sink box consisting of a rigid hull and a buoyant platform having a large central aperture for removable engagement by said hull in assembled condition; said hull defining a relatively deep well, for sitting engagement by a hunter; said platform defining two halves, interconnected by an intermediate lengthwisely-extending hinge member; and locking means, to releasably lockingly interconnect said platform to the top edge portion of said hull concurrently with releasably locking said platform halves in coplanar fashion.

DETAILED DESCRIPTION OF THE EMBODIMENT OF THE INVENTION

Figures 1, 6:
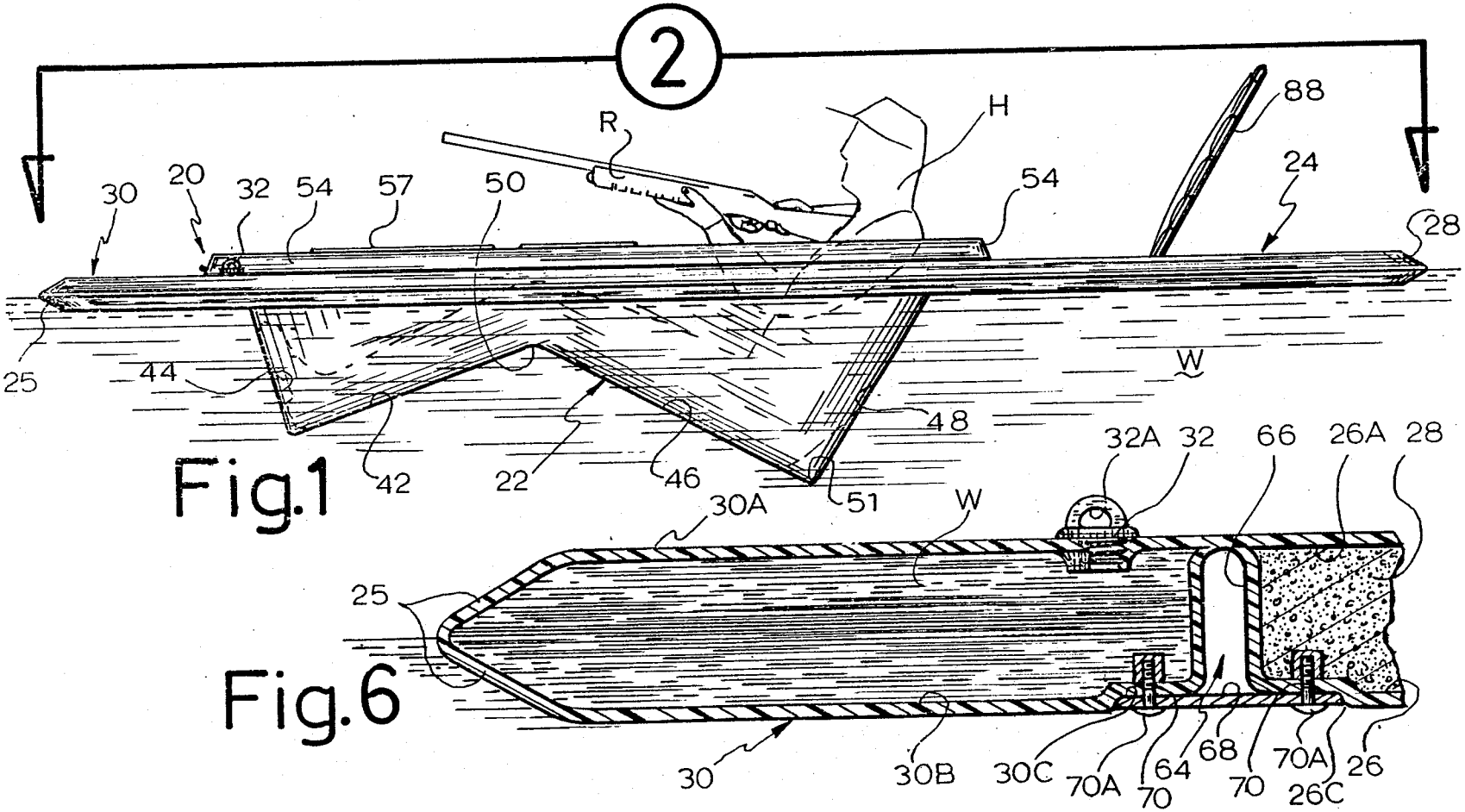
FIG. 1 is a side elevational view of a sink box according to a preferred embodiment of the invention, supporting a hunter in stalk position on water.
FIG. 6, on the first sheet of drawings, is an enlarged vertical sectional view taken along line 6—6 of FIG. 2, at a slightly reduced scale compared to FIGS. 4–5.
Figure 2:
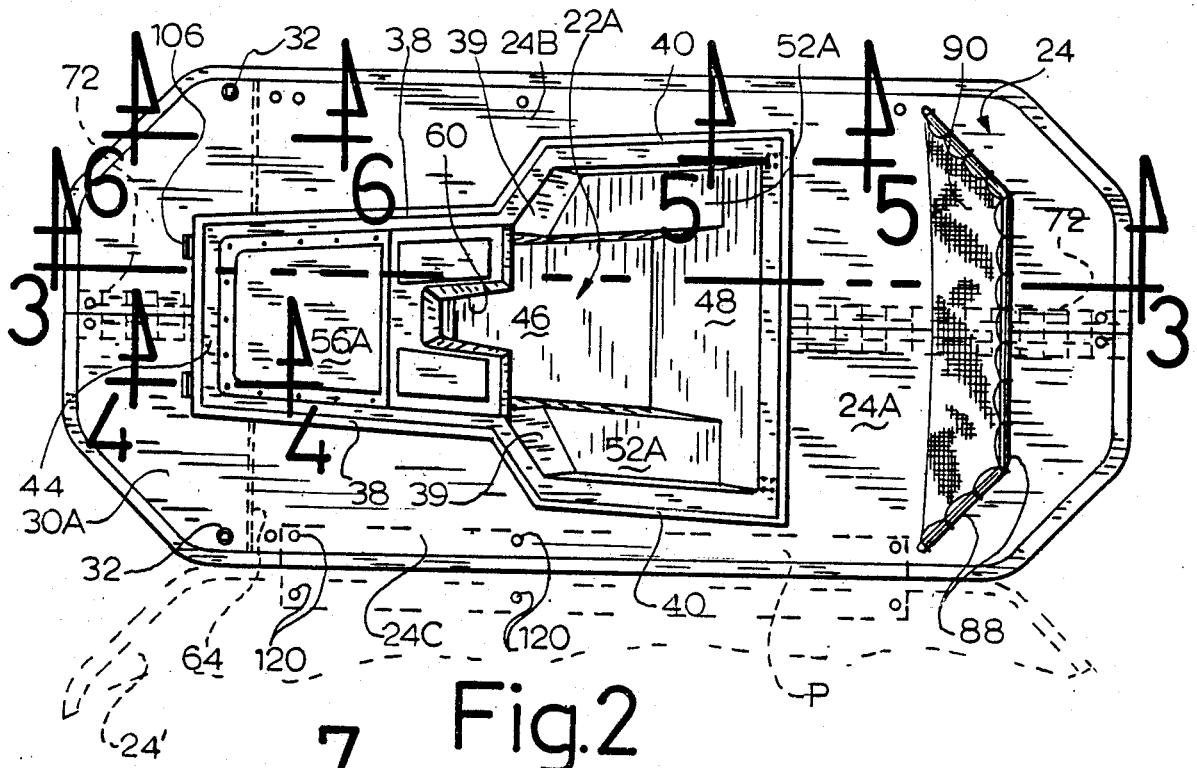
FIG. 2, on the second sheet of drawings, is a reduced, top plan view of the sink box or floating duck blind, taken along line 2 of FIG. 1, and further showing in dotted lines a second floating duck blind connected to the first-mentioned one in accordance with the teachings of the invention.
Figure 4:
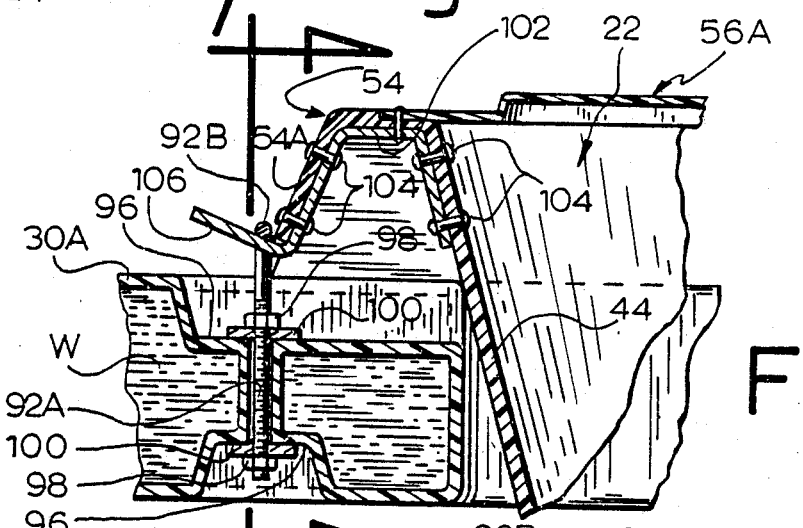
FIG. 4, on the second sheet of drawings, is an enlarged vertical sectional view taken along line 4—4 of FIG. 2, at a scale much larger than that of FIG. 1.
Figure 7:
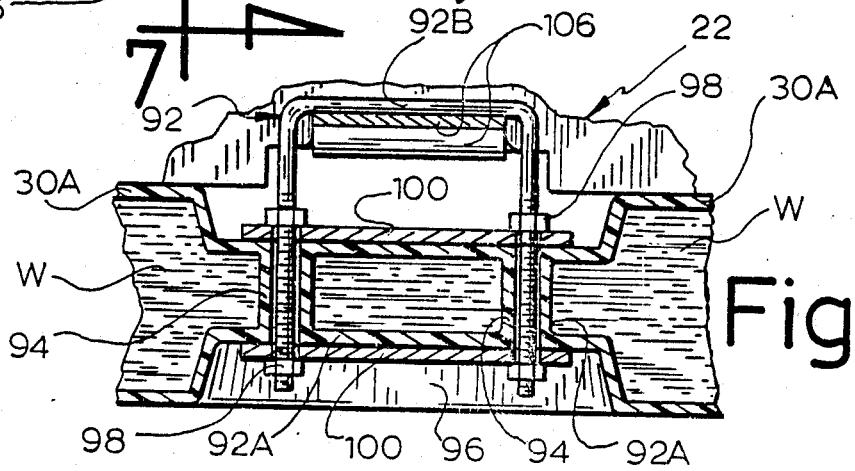
FIG. 7, on the second sheet of drawings, is a crosssectional view taken along line 7—7 of FIG. 4.
Figures 3, 5, 5A, 8:
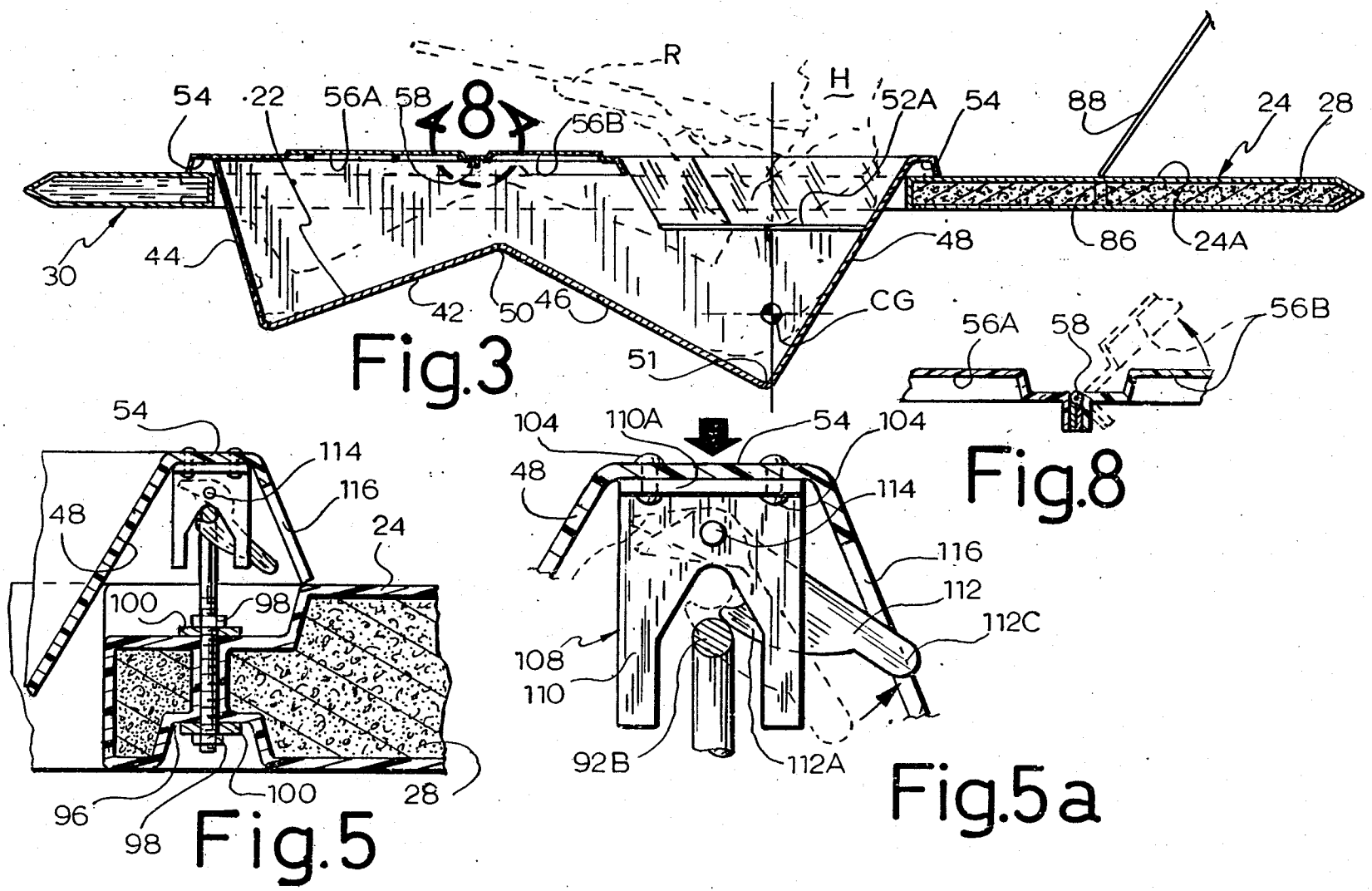
FIG. 3, on the third sheet of drawings, is an enlarged vertical sectional view of the floating duck blind, taken along line 3—3 of FIG. 2 and at about the scale of FIG. 1, and showing the hunter in dotted lines.
FIG. 5, on the third sheet of drawings, is an enlarged vertical sectional view taken along line 5—5 of FIG. 2, at about the scale of FIG. 4.
FIG. 5*a* is an enlarged view of the upper portion of figure 5, showing the relative play of the toggle lever from the quickrelease locking assembly in dotted lines.
FIG. 8, on the third sheet of drawings, is an enlarged view of the area circumscribed in circle 8 of FIG. 3, and showing the pivotal action of the hinge wall assembly in dotted lines.

The preferred embodiment of sink box according to the invention is best shown in FIGS. 1–3 of the drawings, and denoted 20. Sink box 20 consists of two main parts: a hull 22, of irregular shape, and a large flat buoyancy platform 24 surrounding the top section of the hull 22. Platform 24 has an outwardly-tapered peripheral edge 25. A hunter H may sit into the well 22A defined by the hull 22, with only his head projecting outwardly therefrom as clearly seen from FIG. 1. Hull 22 is made of A.B.S. or other waterproof rigid material. Platform 24 constitutes a buoyancy member, including a hollow casing 26 formed from molded polyethylene and the like material, a buoyant material such as urethane 28 and the like filling casing 26 but for the front section thereof at 30. This front section 30 constitutes a ballast tank, which can be adjustably filled with water W through threaded bores made on the outer sides of the top wall 30A of the ballast tank 30 and normally closed by screw plugs 32. Ballast tank 30 has a generally U-shape, with short side legs.

Each screw plug 32 may form an exterior eyelet 32A, for engagement by a dock-in tie rope (not shown).

Figure 9:
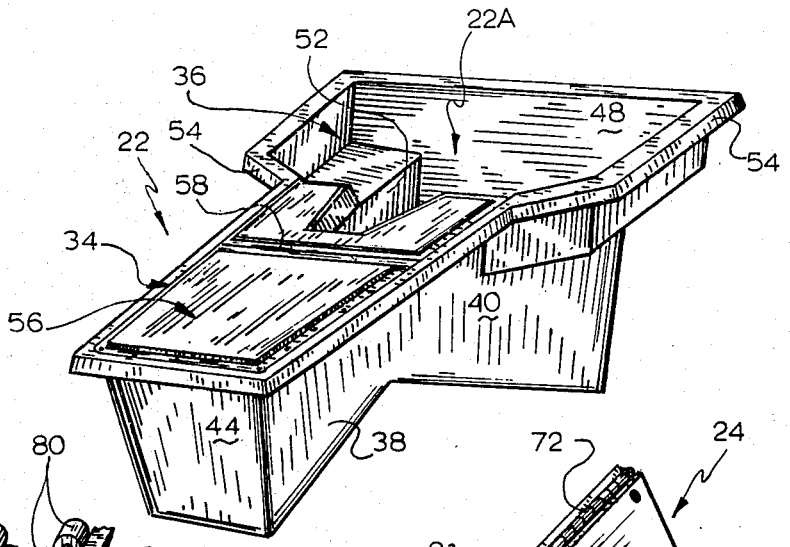
FIG. 9, on the fourth and last sheet of drawings, is a perspective view of the presently preferred embodiment of the hull, shown isolated from its floating platform, and at a reduced scale relative to FIG. 2.

Looking more particularly at the hull 22 shown isolated in FIG. 9, a narrow front portion 34 and a wider rear portion 36 can be defined, being understood that hull 22 is molded in a single integral unit composed of portions 34 and 36. The side walls 38, 40, of portions 34, 36, respectively, are very slightly rearwardly-outwardly-divergent, as is apparent from FIG. 2. Each pair of side walls 38, 40, merge at an inwardly-forwardly-inclined section, denoted 39. The flat flooring 42 of front portion 34 is forwardly-downwardly-inclined, to merge with a steep, upwardly- forwardly-inclined rear wall 44. Similarly, the flat flooring 46 of rear portion 36 is rearwardly downwardly inclined, to merge with a steep, upwardly- rearwardly-inclined rear wall 48. The slope of wall 48 is smaller than that of the front wall 44. Hence, well 22A is shallowest at the intersection of floorings 42 and 46, denoted 50. Moreover, well 22A is deepest at the merging section of flooring 46 and rear wall 48, at section 51.

Flooring 46 advantageously supports a pair of spaced closed boxes 52, integral to side walls 40 and to a small corresponding portion of rear wall 48. The top face of each box 52, at 52A, is flat and parallel to the plane passing through the top edges of side walls 38, 40, and extends below the latter plane. Boxes 52 accordingly have bevelled front and rear walls. Boxes 52 serve as armrests.

The top edges of upright walls 38, 40, 44, and 48, comprise a common outturned peripheral flange 54, and a dependent downwardly-outwardly-inclined continuous lip 54A. A cover plate 56 is provided over side walls 38 and front wall 44, to cover the hull front portion 34 and the front section of the hull rear portion 36. Cover plate 56 is hinged at its intermediate section by a piano hinge, whereby front and rear parts 56A, 56B, are thereby defined. The rear portion of cover plate 56 includes a central U-shaped cavity 60. Front cover part 56A is fixed to the hull while rear cover part 56B can be opened to facilitate ingress and egress by the hunter.

Figure 10:
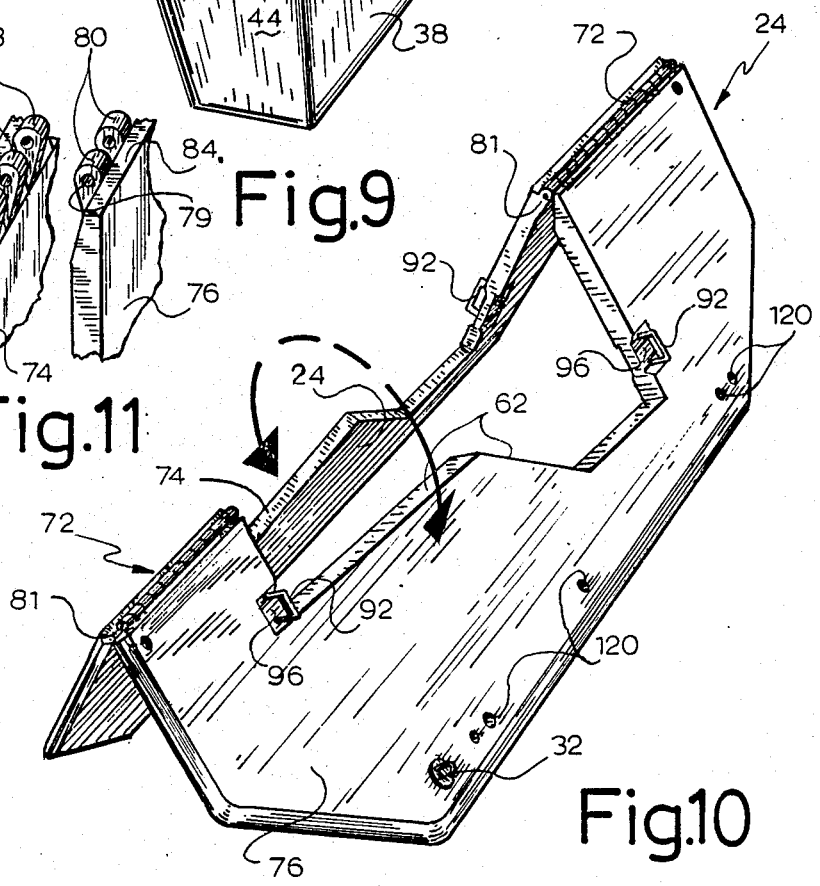
FIG. 10 is an enlarged perspective view of the foldable floating platform, forming part of the present sink box, and showing the relative pivotal play thereof about its hinge.

The platform 24 is best shown in FIGS. 2, 6, and 10. Platform 24 includes a large central aperture 62 adapted to be engaged by hull 22 whereby the peripheral lip 54A and/or walls 44, 48 will abut against the inner portion of platform 24 along aperture 62. Hence, when assembled as shown in FIG. 1, the flange 54 will project upwardly from the plane of the platform 24, while the hull 22 will project downwardly therefrom. The length of the rear portion 24A of the platform 24 is about 3/4th that of hull 22, while that of ballast-tank 30 or the width of the side portions 24B, 24C, of the platform 24, are much smaller.

The ballast-tank 30 is spaced from the buoyancy tank 26 by a partition wall member 64, (FIG. 6) consisting of an involution 66 of the bottom wall 30B of the ballast tank 30. The involution 66 is inversely U-shaped and integrally merges with walls 30A, 30B, and corresponding top and bottom walls 26A, 26B of the buoyancy casing 26. The bottom groove defined by the hollow of involution 66 is closed by a metallic plate 68, extending transversely of platform 24. Plate 68 is lodged in offsets 30C, 26C, in floors 30B, 26C, respectively, so as to be flush therewith (see FIG. 6), and is screwed to same floors 30B, 26C, by bolt and nut assemblies 70. Bolts 70 have a smooth rounded head 70A, so as not to interfere with the flow of water under the platform.

Figure 11:
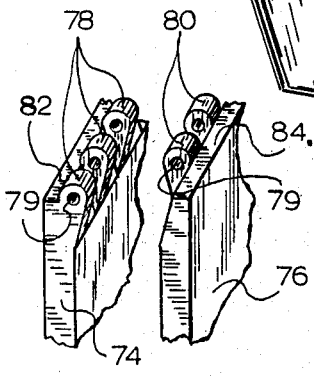
FIG. 11 is an enlarged, fragmentary, exploded, perspective view of a corner portion of the hinge assembly of FIG. 9.

Looking at FIGS. 10–11, platform 24 is hinged at its intermediate longitudinal section, at hinge means 72, whereby two platform halves 74, 76, are defined. Hinge means 72 consists of two pairs of opposite, transversely offset, short cylindrical ears 78, 80, projecting in alternating sequence from the inferior (bottom) half of the inner edges of platform halves 74, 76. Ears 78, 80 are each transversely bored at bore 79, for engagement by an elongated but thin pivotal rod 81 designed to interconnect ears 78 and 80 and thus halves 74 and 76. The exterior half of the inner edge of part 74 forms a cavity 82, while that of part 76 forms an extension 84, whereby upon mating engagement of the alternating opposite ears 78, 80, extension 84 is adapted to flatly abut against the inner edge of part 74 in cavity 82, when halves 74, 76, are coplanar.

The present sink box 20 is advantageous in that it is easily carriable, since hull 22 is readily removable from the central aperture 62 of the platform 24 and the latter is readily foldable about hinge 72 to bring halves 74, 76 against each other. Dismantled sink box 20 can be transported on the roof of any car or in the trunk of any full-size sedan automobile and into a conventional row-boat in order to get on the water to the desired hunting area.

When assembled, sink box 20 will float because of its side and rear buoyant material 28. The hull 22 will project into the water, and a hunter H may enter into the well 22 of the hull 22 directly from his row-boat or from shallow waters. That person will sit on flooring 46, with his legs abutting against flooring 42 and 46, whereby his knees will register with section 50 and hinge 58, with his feet flatly (loosely) abutting against front wall 44, and with his back resting on rear wall 48.

In such a stalk position, the hunter H is comfortable: he remains dry, he can stay there without movement for a few hours, with ease. His rifle R may abut against top wall 56, engaging through cavity 60. The vessel 20 is very stable: the center of gravity CG of the hunter H will be near the pelvis of the hunter, in turn very near the lowermost section 51 of the hull 22 and in substantially vertical register therewith, which in turn would substantially coincide with the center of gravity of the vessel 20 as a whole.

Such a relative position of the center of gravity CG should considerably reduce roll or pitching of the vessel 20. Such roll or pitching will of course occur e.g. in wavy waters or when a shot is fired with a rifle or shotgun. The reader will have noted that the hunter's comfortable resting position is also a comfortable shooting position.

The front ballast-tank 30 is used as follows: when empty, the sink box is forwardly-upwardly-inclined, when floating. The user fills the ballast-tank to make it level. It is emptied to reduce the weight of the sink box for easier transport.

Advantageously, nipples 86 (FIG. 3) are inserted in the rear end portion 24A to removably carry an open rigid frame 86. A canvas 90 is mounted to frame 88 and serves as a shield against rollers whereby the back of the hunter H will not be struck by a sea. When not required, frame 88 and canvas 90 are stored away.

Cover portion 56B is upwardly-outwardly-pivotable about hinge 58 relative to cover portion 56A, for facilitating ingress and egress of the hunter H from the sink box well 22A, see FIG. 8.

We will now examine the means releasably locking the hull 22 to the platform 24, shown in FIGS. 4, 5–5*a* and 7 of the drawings. U-shaped brackets 92 are anchored at each inner corner of the platform 24, each bracket 92 are threaded at 92A and engage a smooth cylindrical sleeve 94 vertically extending through a corner portion 96 of platform 24 of reduced thickness. Opposite nuts 98 and elongated interconnecting washer plates 100 firmly secure the brackets 92 to their respective welled corner portions 96.

Along the front section of the flange 54 and inwardly thereof, there is provided a pair of rigid curved plates 102, conforming to the shape of the flange 54 and lip 54A and of the adjacent section of wall 44, and riveted thereto with rivets 104. Each plate 102 further includes a lip 106 outwardly-upwardly depending from the free edge of flange lip 54A. Plate lip 106 is thus designed to frictionally lockingly engage under the transverse base 92B of its corresponding bracket 92.

Of course, the relative height of this bracket transverse base 92B can be adjusted by the vertical displacement of rods 92A upon unscrewing of one of the two corresponding nuts 98.

Along the rear section of flange 54 and inwardly thereof, there is provided a pair of quick-release locking hook assemblies, denoted 108, mounted to flange 54. Each hook assembly 108 includes an inversely U-shaped bracket 110, having a large base 110A riveted to flange 54 by rivets 104. A hook lever 112 of irregular shape is pivoted at one end to bracket 110, about a pivotal axle 114 which is parallel to the corresponding flange 54. More particularly, hook lever 112 includes an intermediate enlarged hook portion 112A, a conical inner end 112B whereby pivot 114 is intermediate hook 112A and cone 112B, and an opposite outer end 112C adapted to be manipulated by hand and reached through an aperture 116 made in the flange lip 54A.

Hook 112A is designed to engage the base 92B of the rear brackets 92, and when it does, hook lever 112 is brought by its own weight to lock the hook 112A in position to retain flange 54 and platform 24 together.

As suggested in dotted lines in FIG. 2, it is envisioned that sink boxes 20 accordingly with the invention be edgewisely releasably connected side by side. In view thereof, a few large cylindrical bores 120 are made into platform 24, in longitudinal register with plugs 32, bores 120 adapted to be engaged by screw means (not shown) to fixedly secure platform 24, via a connector plate P, to a second platform 24'.

I claim:

1. A foldable sink box consisting of a rigid hull and a buoyant platform having a large central aperture for engagement by said hull in the assembled condition of said platform; said hull defining a relatively deep well, for sitting engagement by a hunter; said platform defining two halves, interconnected by an intermediate lengthwisely-extending hinge member; abutment means to limit the relative displacement of said platform halves between a first folded limit position, and a second extended position defining the assembled condition thereof; and locking means, to releasably lockingly interconnect said platform to the top edge portion of said hull concurrently with releasably locking said platform halves in their assembled condition ; wherein said platform constitutes a hollow casing having main spaced top and bottom walls, a buoyant material located therein but for the front portion thereof which constitutes a ballast-tank which can be adjustably filled with water through a bore made on the top face of said ballast-tank, said bore being inwardly threaded and closed by a screw plug.

2. A sink box as defined in claim 1, wherein said hinge member includes: first short cylindrical ears, spacedly mounted to the interior edge of a first one of said platform halves; second short cylindrical ears, spacedly mounted to the interior edge of the second one of said platform halves; said first ears in alternating positions with respect to said second ears so as to be matingly engageable therebetween, each of said ears having a transverse bore whereby an elongated rod is adapted to engage therethrough for pivotally interconnecting said halves; and wherein each of said platform halves interior edges includes a lower section, bearing said ears, and an upper section, which in the case of the first platform half is a lengthwise cavity and in the case of the second platform half is a lengthwise extension, said cavity and extension adapted to flatly abut against each other when said platform halves are in coplanar position.

3. A sink box as defined in claim 1, wherein a partition wall member separates said ballast-tank from said platform buoyant material and is formed by an upturned involution of said casing bottom wall, said upturned involution merging with said casing top wall.

4. A sink box as defined in claim 1, wherein said hull defines a front well portion and a rear well portion, the latter deeper than the former, each being substantially V-shaped in lengthwise section to define a pair of flat upwardly-divergent flooring walls; the inner flooring walls of said well portions merging at an intermediate section which is downwardly offset from said hull top edge portion; wherein, when the hunter sits into the hull, the center of gravity of the sink box is proximate the apex of said rear well portion.

5. A sink box as defined in claim 4, further including a cover plate, mounted to said hull top edge portion in register with said front well portion, and means to fixedly interconnect said cover plate and said hull top edge portion.

6. A sink box as defined in claim 5, further including an extension for said cover plate, hingedly mounted thereto by a hinge element, the latter transverse to said platform hinge member; said cover plate extension pivotable between a first limit position, extending over the front portion of said rear well portion, and a second limit position, flatly abutting against the top face of said cover plate proper.

7. A sink box as defined in claim 4, further including two arm-rest boxes, mounted to said hull about said rear well portion, the latter defining opposite side walls and a rear wall, said arm-rest boxes being integral to the latter side walls and to a small corresponding portion of the latter rear wall.

8. A sink box as defined in claim 1, wherein said hull edge portion includes a peripheral downturned flange and said locking means comprising a pair of transverselyspaced front locking assemblies and at least one rear locking assembly; each one of said front locking assemblies including a fixed hook, said rear locking assembly including a pivotable locking lever, said hooks and lever mounted under said flange, each assembly further including an inversely U-shaped bracket having two threaded legs, screwed to said platform, and a base leg, engaged by said hooks and lever when the sink box is assembled.

9. A sink box as defined in claim 8, wherein each said bracket threaded leg engages a smooth sleeve, transversely anchored to a reduced-thickness section of said platform, a pair of opposite bolt members locking said bracket threaded legs to said reduced-thickness section; whereby the relative height of the bracket base leg can be adjusted.

10. A sink box as defined in claim 8, wherein said locking lever is of the self-locking type.

11. A sink box as defined in claim 10, further including locking means to prevent accidental release of said lever.

* * * * *